US010077601B2

(12) United States Patent
Leng

(10) Patent No.: US 10,077,601 B2
(45) Date of Patent: Sep. 18, 2018

(54) OVERTURN STRUCTURE OF A FOOTSTEP OF A FOLDING LADDER

(71) Applicant: NEW-TEC INTEGRATION (XIAMEN) CO., LTD., Xiamen, Fujian (CN)

(72) Inventor: Luhao Leng, Fujian (CN)

(73) Assignee: New-Tec Integration (Xiamen) Co., Ltd., Xiamen, Fujian (CN)

( * ) Notice: Subject to any disclaimer, the term of this patent is extended or adjusted under 35 U.S.C. 154(b) by 0 days.

(21) Appl. No.: 14/847,760

(22) Filed: Sep. 8, 2015

(65) Prior Publication Data

US 2017/0067291 A1 Mar. 9, 2017

(51) Int. Cl.

| | |
|---|---|
| ***E06C 1/393*** | (2006.01) |
| ***E06C 7/08*** | (2006.01) |
| ***E06C 1/16*** | (2006.01) |

(52) U.S. Cl.

CPC ..... *E06C 7/082* (2013.01); *E06C 1/16* (2013.01); *E06C 1/393* (2013.01)

(58) Field of Classification Search

CPC . E06C 1/387; E06C 1/393; E06C 1/14; E06C 1/16; E06C 1/18; E06C 1/20; E06C 1/22; E06C 1/32; E06C 1/38; E06C 1/383; E06C 1/3835; E06C 7/00; E06C 7/08; E06C 7/082; E06C 7/083; E06C 7/084; E06C 7/086; E06C 7/087

See application file for complete search history.

(56) References Cited

U.S. PATENT DOCUMENTS

| | | | | |
|---|---|---|---|---|
| 2,952,301 A * | 9/1960 | Schlaak | ..... | A47C 12/02 182/106 |
| 6,012,548 A * | 1/2000 | Kim | ..... | E06C 1/387 182/156 |
| 6,039,149 A * | 3/2000 | Bedja | ..... | B62B 1/12 182/165 |
| 6,550,579 B2 * | 4/2003 | Gibson | ..... | E06C 1/387 182/161 |
| 7,182,176 B2 * | 2/2007 | Gibson | ..... | A47C 12/00 182/129 |

(Continued)

FOREIGN PATENT DOCUMENTS

CN 201902159 U 7/2011

*Primary Examiner* — Daniel P Cahn

(74) *Attorney, Agent, or Firm* — Edward E. Sowers; Brannon Sowers & Cracraft PC

(57) ABSTRACT

An overturn structure of a footstep of a folding ladder, includes a footstep is disposed between two legs, wherein further comprising two pivot elements and a reinforcing bar connecting between the two legs, the pivot elements are respectively connected to both ends of the reinforcing bar, the pivot elements are pivoted joint to the footstep to make the footstep overturn about the reinforcing bar to fold and unfold, when the footstep is unfolded, the reinforcing bar is supported on the bottom portion of the footstep. The pivot elements are connected to the reinforcing bar, the pivot elements are pivoted joint to the footstep, the footstep can rotate about the reinforcing bar to fold and unfold, so that the structure is stable, when the footstep is unfolded, the reinforcing bar is supported on the bottom portion of the footstep, it thus significantly improves the bearing performance of the footstep.

3 Claims, 6 Drawing Sheets

(56) References Cited

U.S. PATENT DOCUMENTS

| | | | | |
|---|---|---|---|---|
| 7,849,967 | B2 * | 12/2010 | Gibson | E06C 1/393 182/165 |
| 8,002,084 | B2 * | 8/2011 | Huang | E06C 1/18 182/159 |
| 8,684,139 | B2 * | 4/2014 | Leng | A47C 12/00 182/129 |
| 8,997,931 | B2 * | 4/2015 | Parker | E06C 1/383 182/116 |
| 9,500,029 | B1 * | 11/2016 | Mullins | E06C 1/393 |
| 2002/0043431 | A1 * | 4/2002 | Gibson | E06C 1/387 182/161 |
| 2003/0057022 | A1 * | 3/2003 | Leng | E06C 1/393 182/165 |
| 2004/0099479 | A1 * | 5/2004 | Sagol | E06C 1/393 182/165 |
| 2004/0231920 | A1 * | 11/2004 | Meeker | E06C 7/087 182/165 |
| 2005/0029049 | A1 * | 2/2005 | Moser | E04G 1/28 182/152 |
| 2005/0284701 | A1 * | 12/2005 | Gibson | A47C 12/00 182/165 |
| 2007/0181369 | A1 * | 8/2007 | Gibson | E06C 1/393 182/165 |
| 2008/0142301 | A1 * | 6/2008 | Meyers | E06C 1/387 182/180.1 |
| 2008/0179138 | A1 * | 7/2008 | Parker | E06C 1/387 182/106 |
| 2009/0020360 | A1 * | 1/2009 | May | B60R 3/02 182/1 |
| 2014/0190769 | A1 * | 7/2014 | Parker | E06C 1/383 182/159 |

* cited by examiner

OVERTURN STRUCTURE OF A FOOTSTEP OF A FOLDING LADDER

FIELD OF THE INVENTION

The present invention relates to an overturn structure of a footstep of a folding ladder.

BACKGROUND OF THE INVENTION

Ladders are daily supplies, they are tools used in fetching overhead things, in maintaining equipment at high position, or other situations. For example, the family room usually has its top cabinet high, therefore it is inconvenient to fetch the odds in the top cabinet, a ladder is then used; another example, the library has many bookshelves, it is convenient to catch the books on the lower layers, but it is very inconvenient to catch the boos on the higher layers, it also needs a ladder to catch the books.

In the existing technology, there is a simple folding aluminum ladder, for example, disclosed is in the Chinese patent database with announcement number CN20192159U, comprises two front legs, two rear legs and a plurality of footsteps, the footsteps are pivoted joint between the two front legs. The footstep of the folding ladder is pivoted joint to the front legs by its side surface, the footstep has limited bearing performance, after long time's use, the footsteps may deform that it reduces the service life of the ladder.

SUMMARY OF THE INVENTION

The present invention is provided with an overturn structure of a footstep of a folding ladder, which overcomes the disadvantages of the existing known technology. The technical proposal of the present invention is that:

An overturn structure of a footstep of a folding ladder, comprising a footstep and two legs, the footstep is disposed between the two legs, wherein further comprising two pivot elements and a reinforcing bar connecting between the two legs, the pivot elements are respectively connected to both ends of the reinforcing bar, the pivot elements are pivoted joint to the footstep to make the footstep overturn about the reinforcing bar to fold and unfold, when the footstep is unfolded, the reinforcing bar is supported on the bottom portion of the footstep.

In another preferred embodiment, the pivot element comprises a fixation portion and a connecting portion, the connecting portion is connected to the reinforcing bar, the connecting portion is arc shaped, the bottom portion of the footstep is disposed with an arc lock groove, the connecting portion is inserted to the arc lock groove.

In another preferred embodiment, the connecting portion is connected to the outer edge of the fixation portion.

In another preferred embodiment, the central portion of the reinforcing bar is bent to be arched shaped.

In another preferred embodiment, the reinforcing bar is a hollow pipe.

Comparing to the existing known technology, the technical proposal of the present invention has advantages as follows:

1. The pivot elements are connected to the reinforcing bar, the pivot elements are pivoted joint to the footstep, the footstep can rotate about the reinforcing bar to fold and unfold, so that the structure is stable, when the footstep is unfolded, the reinforcing bar is supported on the bottom portion of the footstep, it thus significantly improves the bearing performance of the footstep.

2. The pivot elements are locked to the footstep, when the central portion of the footstep is under pressure, the pivot elements provides resistance to the extending and deforming of the footstep from two sides to the middle portion, it cushions the footstep against sagging in the center and deforming, thus improving the strength of the footstep.

3. The central portion of the reinforcing bar is bent to arched shape, so that the central portion of the reinforcing bar can be more close to central position of the footstep, it thus improves the bearing performance of the central position.

BRIEF DESCRIPTION OF THE DRAWINGS

The present invention will be further described with the drawings and the embodiments.

DETAILED DESCRIPTION OF THE EMBODIMENTS

Figure 1:
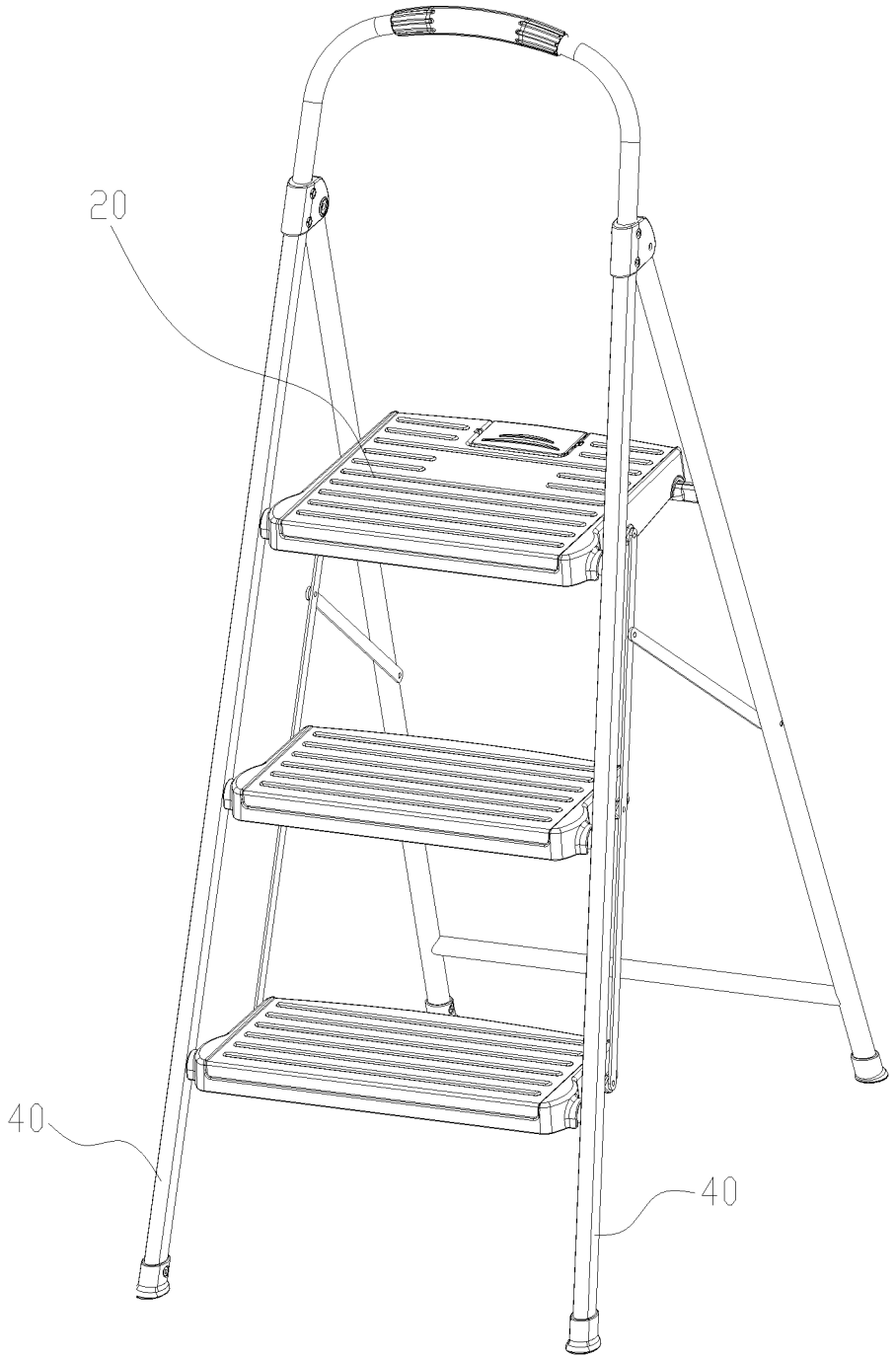
FIG. 1 illustrates a schematic diagram of an overturn structure of a footstep of a folding ladder of the present invention.
Figure 2:
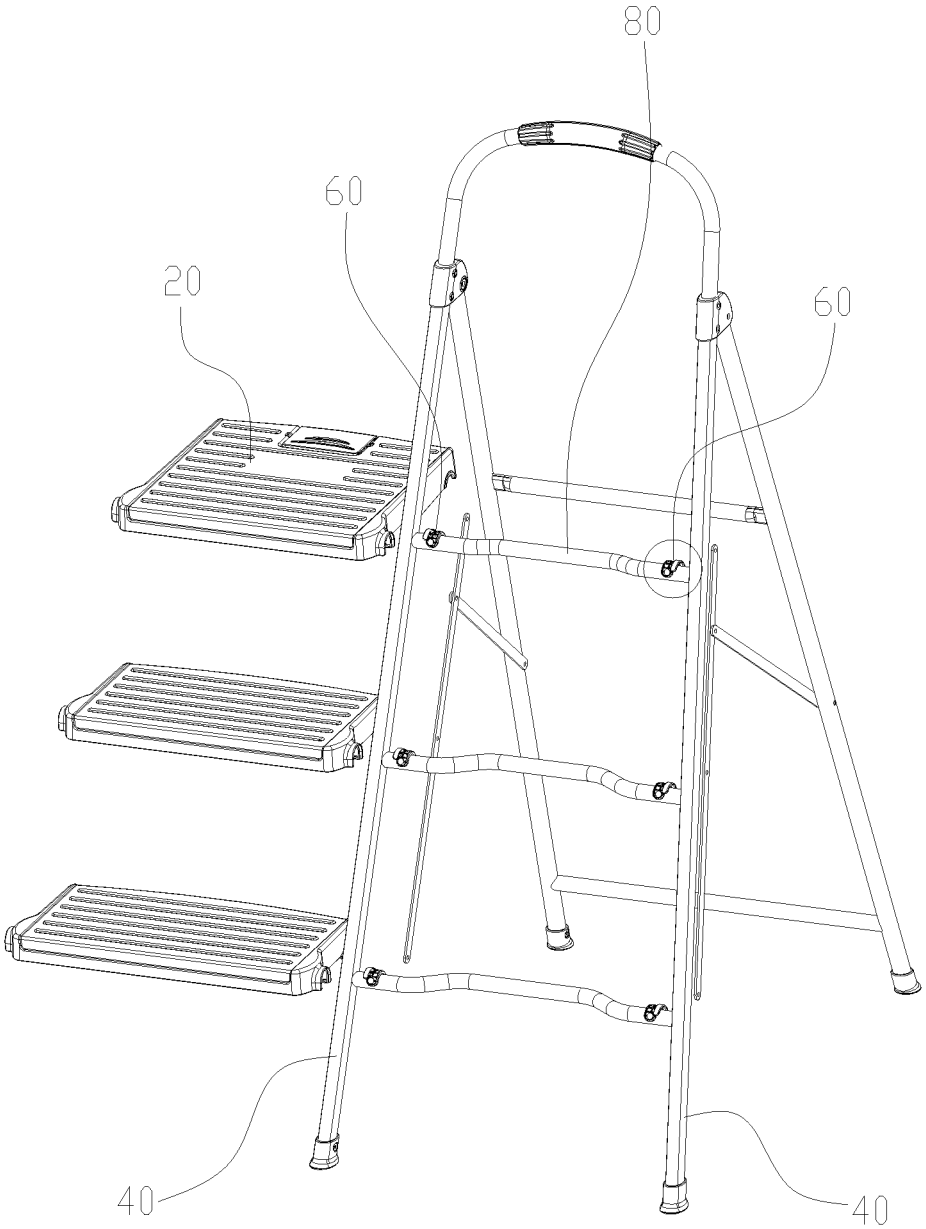
FIG. 2 illustrates an exploded and schematic diagram of the overturn structure of a footstep of a folding ladder of FIG. 1.
Figure 6:
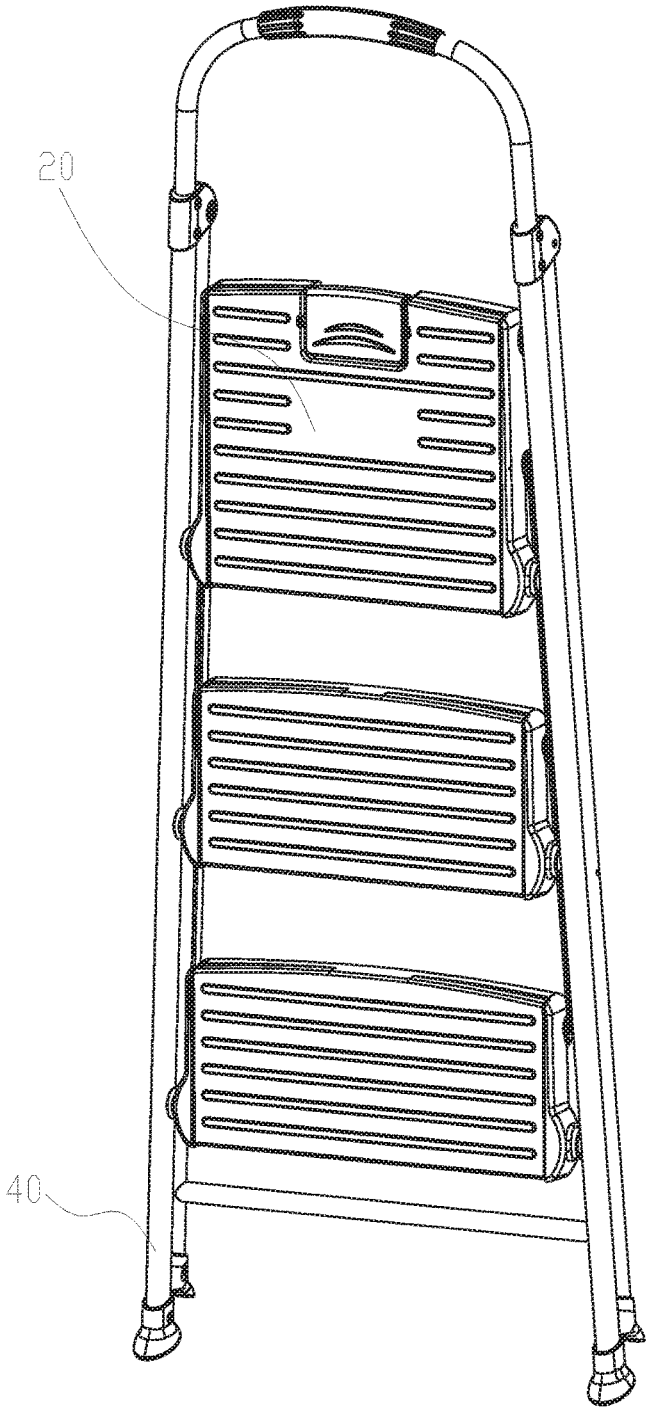
FIG. 6 illustrates a folding ladder of FIG. 1 in a folded state.

Referring to FIGS. 1-2 and 6, an overturn structure of a footstep of a folding ladder comprises a footstep 20, two legs 40, two pivot elements 60 and a reinforcing bar 80. The folding ladder can be configured with a plurality of footsteps as needed, when an overturn structure of the present invention is applied in even one footstep, it can be noted that it is still within the scope the present invention claims.

Figure 5:
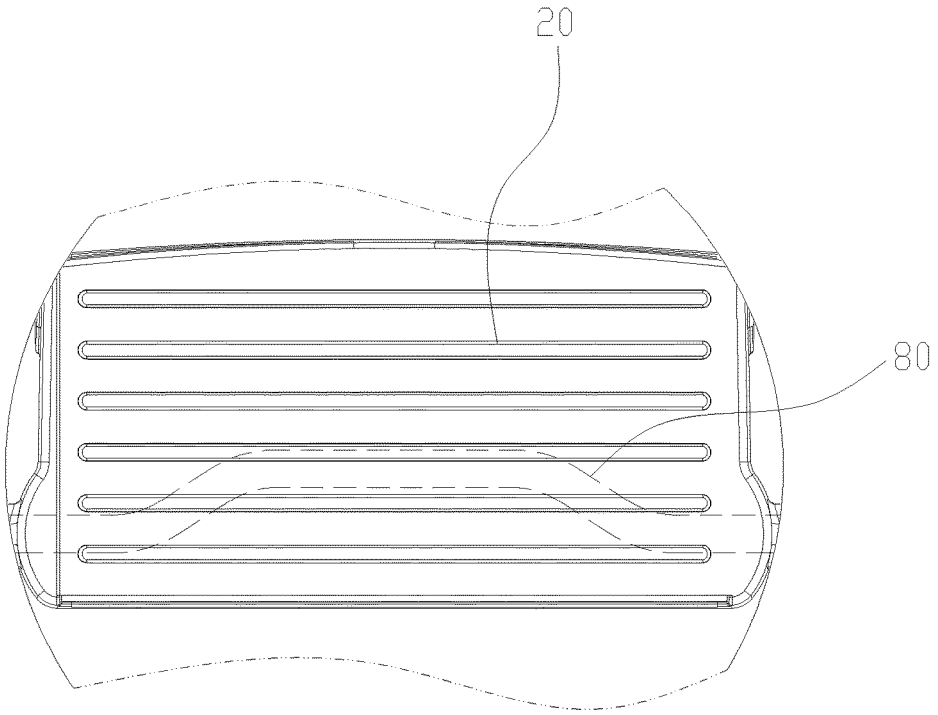
FIG. 5 illustrates a schematic diagram of the positions of the footstep and the reinforcing bar of the overturn structure of FIG. 1.

Referring to FIG. 2 and FIG. 5, the reinforcing bar 80 is connected between the two legs 40, the end portions of the reinforcing bar 80 are welded to the legs. The central portion of the reinforcing bar 80 is bent to be arched shaped. Preferred, the reinforcing bar 80 is a hollow pipe.

Figure 3:
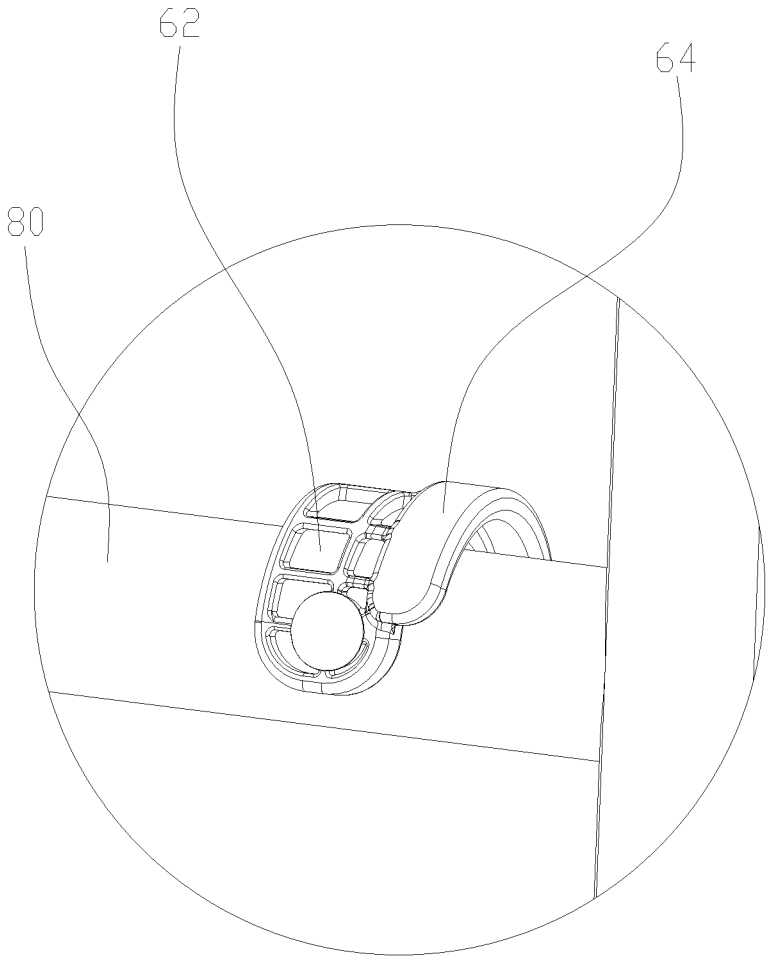
FIG. 3 illustrates an enlargement diagram of A in FIG. 2.

Referring to FIG. 2 and FIG. 3, two pivot elements 60 are symmetrically connected to the two ends of the reinforcing bar 80. The pivot element 60 comprises a fixation portion 62 and a connecting portion 64. The fixation portion 62 is riveted to the reinforcing bar 80. The connecting portion 64 is connected to the outer edge of the fixation portion 62. The connecting portion 64 is arc shaped.

Figure 4:
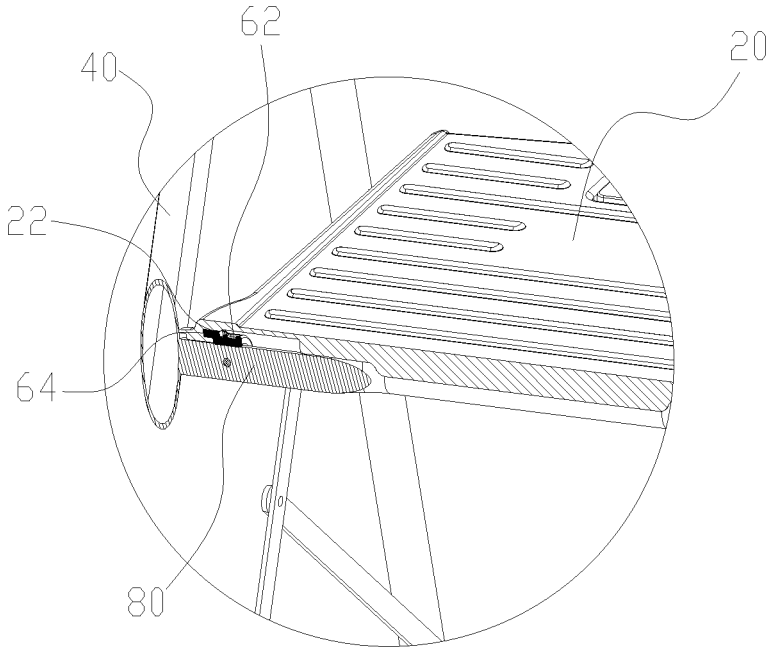
FIG. 4 illustrates a schematic diagram of the internal connecting of the overturn structure of FIG. 1.

Referring to FIG. 4, the footstep 20 is disposed between two legs 40, the bottom portion of the footstep 20 is disposed with an arc lock groove 22 corresponding to the connecting portion 64, the connecting portion 64 is inserted to the arc lock groove 22, the connecting portion 64 can rotate forth and back about the arc lock groove 22.

As the pivot elements 60 are pivoted joint to the footstep 20, the footstep 20 can rotate about the reinforcing bar 80 and overturn to fold and unfold, when the footstep 20 is unfolded, the reinforcing bar 80 is supported on the bottom portion of the footstep 20.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A folding ladder comprising:

two legs;

a reinforcing bar, the reinforcing bar located between the two legs and defining a length;

a footstep disposed between the two legs, the footstep having a width substantially corresponding to the length of the reinforcing bar, a bottom portion and two arc shaped lock grooves on the bottom portion; and two pivot elements, each of the two pivot elements having a fixation portion and a connecting portion resulting in two fixation portions and two connecting portions, each of the fixation portions being riveted to the reinforcing bar, each of the fixation portions having a convex outer edge, each of the connecting portions having a concave inner surface for engaging the convex outer edge, and an external arc shaped surface corresponding to a respective one of the arc shaped lock grooves, and the two connecting portions respectively inserted into the two arc shaped lock grooves on the bottom portion, the arc shaped lock grooves respectively configured to rotate about the reinforcing bar.

2. The folding ladder according to claim 1, wherein the connecting portion is distal from the fixation portion.

3. The folding ladder according to claim 1, wherein a center portion of the reinforcing bar is arch shaped.

* * * * *